US011650547B2

(12) United States Patent
Tschumi

(10) Patent No.: US 11,650,547 B2
(45) Date of Patent: May 16, 2023

(54) SUB-ASSEMBLY OF EXTERNAL PARTS FOR TIMEPIECE OR WATCH OR A PIECE OF JEWELLERY

(71) Applicant: The Swatch Group Research and Development Ltd, Marin (CH)

(72) Inventor: Philipp Tschumi, Niederwil (CH)

(73) Assignee: The Swatch Group Research and Development Ltd, Marin (CH)

( * ) Notice: Subject to any disclaimer, the term of this patent is extended or adjusted under 35 U.S.C. 154(b) by 272 days.

(21) Appl. No.: 17/025,571

(22) Filed: Sep. 18, 2020

(65) Prior Publication Data

US 2021/0088975 A1 Mar. 25, 2021

(30) Foreign Application Priority Data

Sep. 20, 2019 (EP) ..... 19198517

(51) Int. Cl.
*G04B 37/11* (2006.01)
*A44C 5/14* (2006.01)
(Continued)

(52) U.S. Cl.
CPC ..... *G04B 37/11* (2013.01); *A44C 5/147* (2013.01); *G04B 19/283* (2013.01); *G04B 37/106* (2013.01)

(58) Field of Classification Search
CPC .. G04B 37/0041; G04B 37/005; G04B 37/08; G04B 37/11; G04B 19/283;
(Continued)

(56) References Cited

U.S. PATENT DOCUMENTS 3,817,026 A 6/1974 Lopez
7,126,881 B2 10/2006 Cooper et al.
(Continued)

FOREIGN PATENT DOCUMENTS

CN 101238420 A 8/2008
CN 101299144 A 11/2008
(Continued)

OTHER PUBLICATIONS

Combined Chinese Office Action and Search Report dated Jul. 21, 2021 in Patent Application No. 202010985387.6 (with English translation of Category of Cited Documents), 7 pages.
(Continued)

*Primary Examiner* — Edwin A. Leon
(74) *Attorney, Agent, or Firm* — Oblon, McClelland, Maier & Neustadt, L.L.P.

(57) ABSTRACT

A sub-assembly of external parts including, a bolt interposed between a first component and a second component compressing together a joint, securing them together by axially blocking the first component, and which cooperates with the second component to enclose a ball occupying a well of depth greater than its diameter, that an orientation housing in the second component or the bolt includes, framed by channels of depth less than its diameter, limited by stops, which ball can occupy, when subjected to the gravity field and/or a magnetic field, both an orientation housing and a complementary housing of depth less than its diameter, that the bolt or respectively the second component includes, for their relative drive by the ball when it is simultaneously braced on a channel and a complementary housing.

21 Claims, 3 Drawing Sheets

(51) Int. Cl.
*G04B 19/28* (2006.01)
*G04B 37/10* (2006.01)

(58) Field of Classification Search
CPC .... G04B 37/106; G04B 37/087; A44C 25/00; A44C 27/00; A44C 5/147
See application file for complete search history.

(56) References Cited

U.S. PATENT DOCUMENTS

| | | | | |
|---|---|---|---|---|
| 7,572,049 | B2 * | 8/2009 | Hiranuma | G04B 19/286 368/295 |
| 7,942,574 | B2 * | 5/2011 | Hozumi | G04B 3/043 368/308 |
| 2001/0040840 | A1 * | 11/2001 | Terasawa | G04B 19/283 368/295 |
| 2003/0016591 | A1 | 1/2003 | Meyrat et al. | |
| 2003/0210614 | A1 | 11/2003 | Cooper et al. | |
| 2008/0225650 | A1 | 9/2008 | Muller et al. | |
| 2014/0313870 | A1 * | 10/2014 | Bolzt | G04B 37/0025 368/294 |
| 2018/0032033 | A1 * | 2/2018 | Mollier | G04B 37/0463 |

FOREIGN PATENT DOCUMENTS

| | | | |
|---|---|---|---|
| CN | 103926825 | A | 7/2014 |
| CN | 107656432 | A | 2/2018 |
| CN | 107656434 | A | 2/2018 |
| CN | 109946946 | A | 6/2019 |
| DE | 20 2005 003 029 | U1 | 10/2005 |
| EP | 1 278 108 | A1 | 1/2003 |
| EP | 1 278 108 | B1 | 1/2003 |
| EP | 1 760 556 | A1 | 3/2007 |
| FR | 2 201 496 | A1 | 4/1974 |

OTHER PUBLICATIONS

Notice of the Reason for Refusal dated Jul. 27, 2021 in Japanese Patent Application No. 2020-133684 (with English language translation), 10 pages.

European Search Report dated Mar. 12, 2020 in European Application 19198517.5 filed on Sep. 20, 2019 (with English Translation of Categories of Cited Documents), 7 pages.

* cited by examiner

SUB-ASSEMBLY OF EXTERNAL PARTS FOR TIMEPIECE OR WATCH OR A PIECE OF JEWELLERY

CROSS-REFERENCE TO RELATED APPLICATION

This application claims priority to European Patent Application No. 19198517.5 filed on Sep. 20, 2019, the entire disclosure of which is hereby incorporated herein by reference.

FIELD OF THE INVENTION

The invention relates to a sub-assembly of external parts for a timepiece or watch or for a piece of jewellery, including, coaxially with a first component and a second component, compressing together a sealing and friction joint, and interposed therebetween, a bolt securing them together by axially blocking said first component, and a lower surface of which lies, in the assembled position, in the vicinity of an upper surface of said second component.

The invention also relates to a timepiece, in particular a watch, including such a sub-assembly of external parts.

The invention also relates to a piece of jewellery including such a sub-assembly of external parts.

The invention also relates to a method for assembling such a sub-assembly of external parts.

The invention relates to the field of external parts of watches, and the field of jewellery.

BACKGROUND OF THE INVENTION

The external parts of watches and similar apparatuses obeys many constraints, particularly sealing, robustness, appearance constraints, and must be carried out in such a way as to prevent any unintentional dismounting resulting irreparably in an after-sales intervention for joint exchange, cleaning, lubrication, even repair.

Some external part or control components must also be angularly indexed relative to one another, for origin reference position, rest, or actuation location, or else to facilitate the reading of indications or graduations, or to ensure the continuity of left surfaces and/or decorations. This angular indexing is often difficult to achieve well, in combination with a good gripping of the components and with a perfect water-resistance of the joints.

SUMMARY OF THE INVENTION

The invention intends to produce a water-resistant and secure assembly of external part components with an easy-to-adjust angular indexing.

To this end, the invention relates to a sub-assembly of external parts for a timepiece or for a piece of jewellery according to claim 1.

The invention also relates to a timepiece, in particular a watch, including such a sub-assembly of external parts.

The invention also relates to a piece of jewellery including such a sub-assembly of external parts.

The invention also relates to a method for assembling such a sub-assembly of external parts.

BRIEF DESCRIPTION OF THE DRAWINGS

Other features and advantages of the invention will appear upon reading the detailed description that follows, with reference to the appended drawings, where.

DETAILED DESCRIPTION OF PREFERRED EMBODIMENTS

Figure 1:
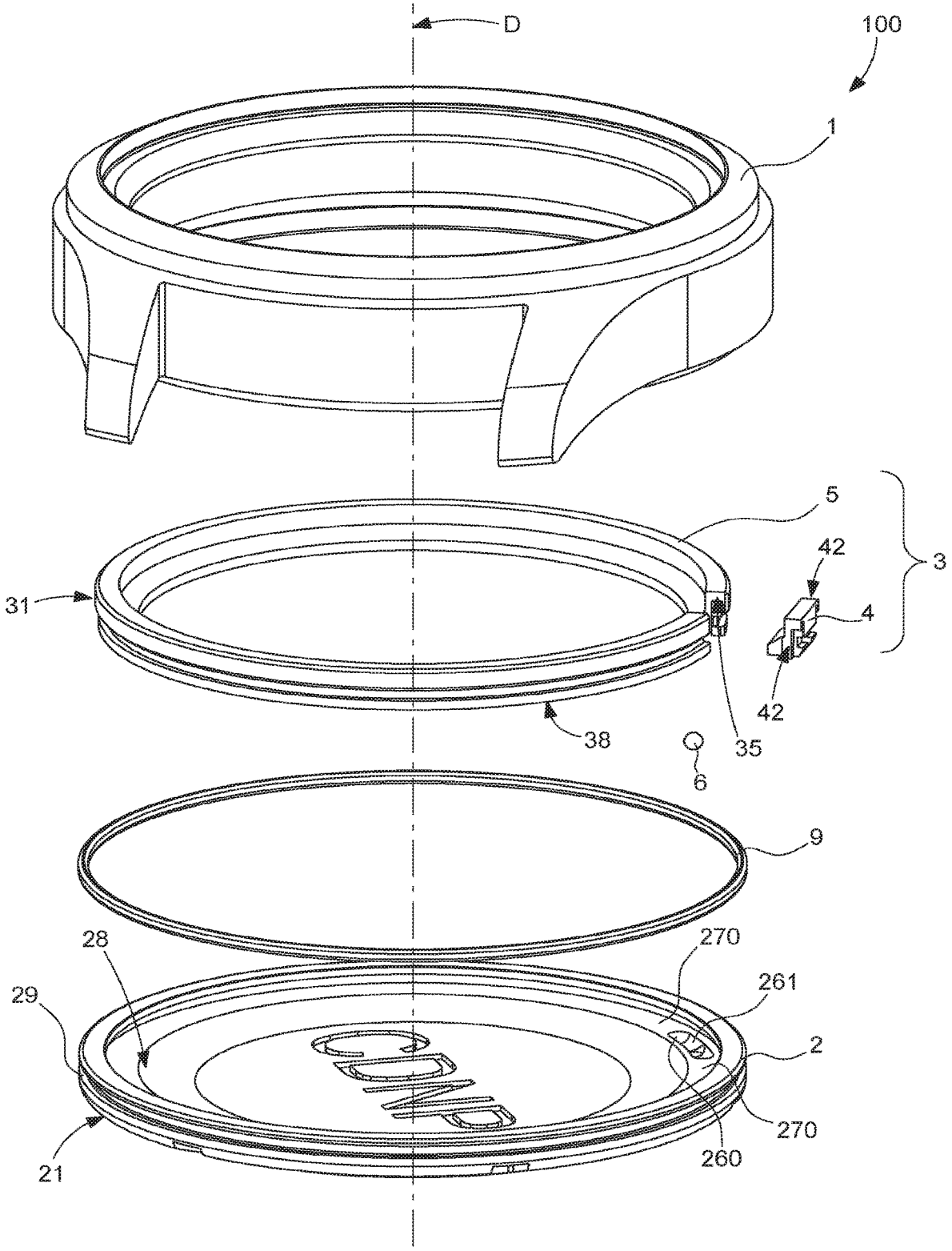
FIG. 1 schematically shows, in exploded perspective, a particular variant of a sub-assembly of external parts according to the invention, including a first component which is a middle part, under which is shown a second component which is a back, and a bolt which is an elastic split ring, including an insert, which bolt is intended to be inserted between the first component and the second component, the latter trapping therebetween a sealing and friction joint, the second component and the bolt enclosing together a ball which can rest in a well that one of them includes, and which, in a phase of angular adjustment between the first component and the second component, can be supported on two complementary housings, carried one by the bolt and the other by the second component, for their relative drive.
Figure 2:
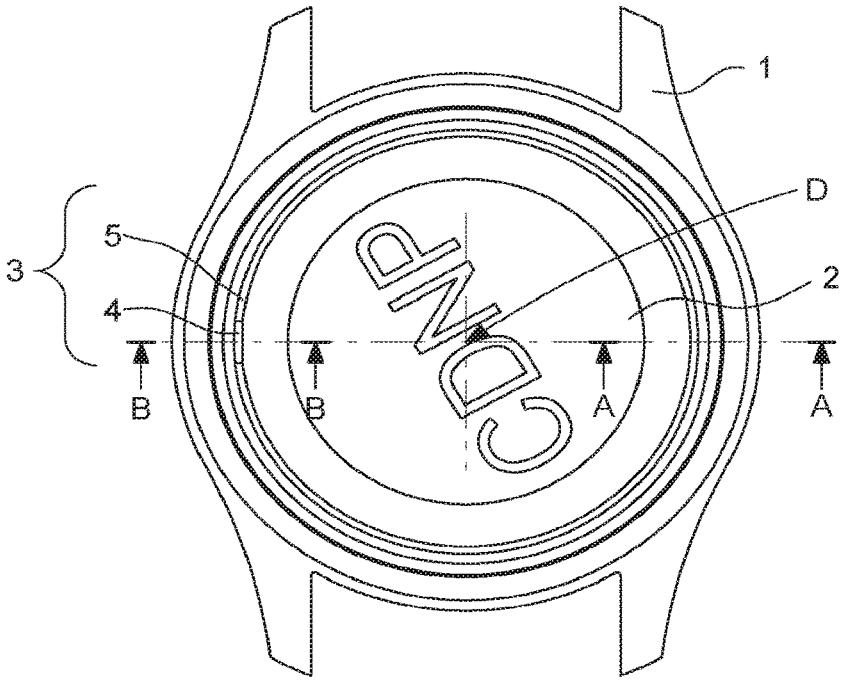
FIG. 2 shows, in top view, the sub-assembly of FIG. 1 in the assembled position.
Figure 3:
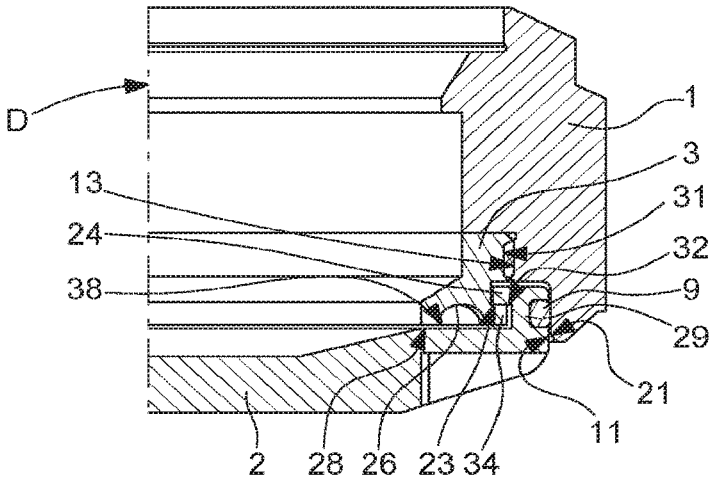
FIG. 3 is a cross section along the section plane AA of FIG. 2.
Figure 4:
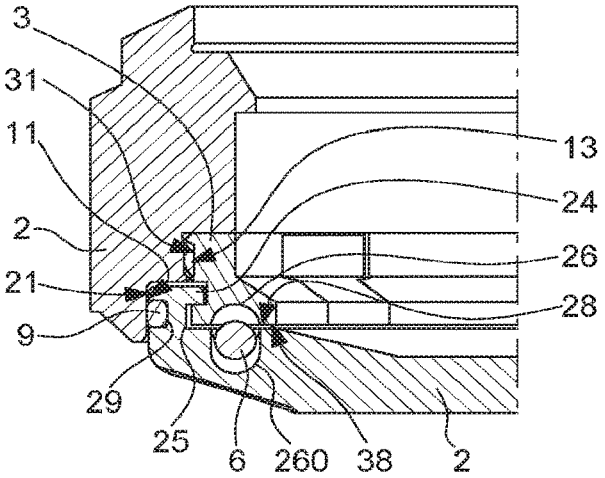
FIG. 4 is a cross section along the section plane BB of FIG. 2, passing through the ball resting in a well of an orientation housing that the second component includes, the bolt being shown in an angular position where it has a complementary housing above the ball.
Figure 5:
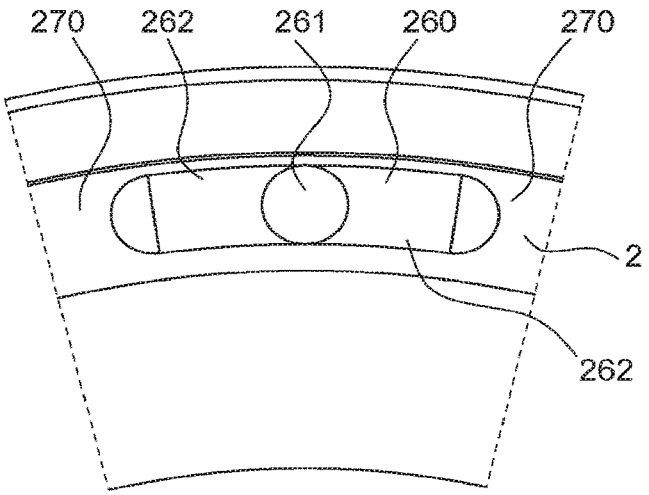
FIG. 5 is a detail, in top view, of the orientation housing that the second component includes, in the shape of an annular sector.
Figure 6:
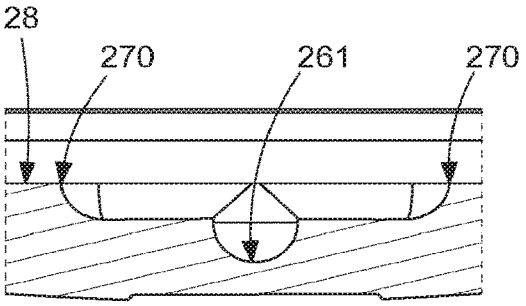
FIG. 6 is the development of a section of this same housing, along a cylindrical cutting surface around the axis common to the first component, to the second component, and to the bolt.
Figure 7:
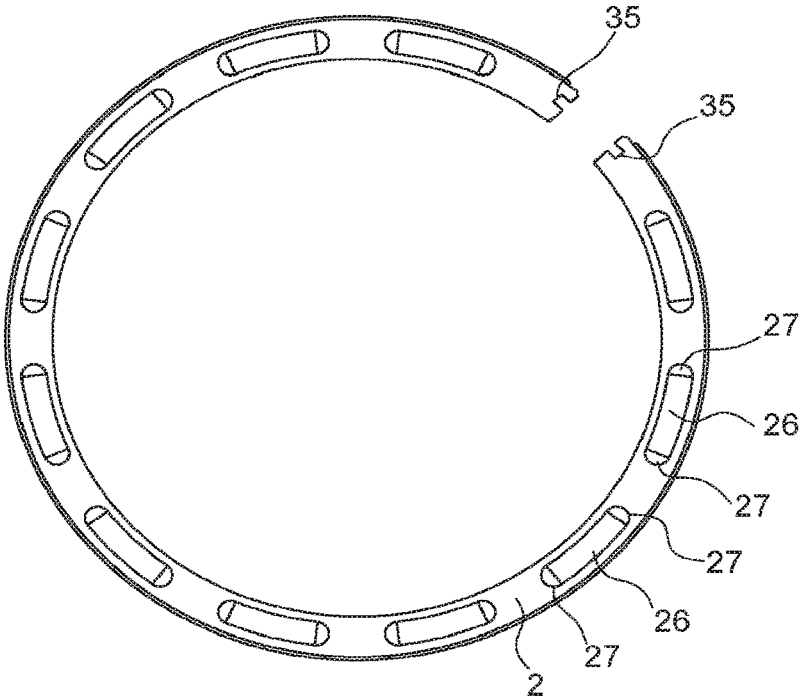
FIG. 7 is a bottom view, of the bolt and the complementary housings, in the shape of an annular sector, which it includes.

The invention intends to produce a water-resistant and secure assembly of external part components with an easy-to-adjust angular indexing, and in a guaranteed position, with a minimum number of components, and moderate manufacturing costs.

The figures illustrate the non-limiting example of the angular indexing of a back relative to a watch middle part.

DETAILED DESCRIPTION OF PREFERRED EMBODIMENTS

The invention intends to produce a water-resistant and secure assembly of external part components with an easy-to-adjust angular indexing, and in a guaranteed position, with a minimum number of components, and moderate manufacturing costs.

The figures illustrate the non-limiting example of the angular indexing of a back relative to a watch middle part.

The invention relates to a sub-assembly of external parts 100 for a timepiece, more particularly for a watch, or for a piece of jewellery.

This sub-assembly of external parts 100 for a timepiece or for a watch or for a piece of jewellery includes a first component 1 and a second component 2, compressing together at least one sealing and friction joint 9.

The sub-assembly of external parts 100 also includes, coaxially with this first component 1 and this second component 2, and interposed therebetween, a bolt 3 which secures them by axially blocking the first component 1. This bolt 3 includes a lower surface 38 which is, in the assembled position of the sub-assembly of external parts 100, in the vicinity of an upper surface 28 of the second component 2.

According to the invention, this lower surface 38 and this upper surface 28 cooperate with each other to enclose a ball 6 therebetween. This ball 6 is arranged to occupy, in a static rest position, a well 261, that an orientation housing 260 in the second component 2 or the bolt 3 includes. The depth of this well 261 is greater than the diameter of the ball 6. In this orientation housing 260, the well 261 is framed by channels 262, the depth of which is less than the diameter of the ball 6, and which are limited by limiting borders 27. During an adjustment operation during which the angular indexing is carried out between the first component 1 and the second component 2, the position in space of the sub-assembly 100 can be modified, to modify the position of the ball 6 relative to the lower surface 38 and this upper surface 28, and/or to subject the ball 6 made of ferromagnetic material to a magnetic field. The ball 6 can then occupy, during such an adjustment where it is subjected to the gravity field and/or to a magnetic field, both an orientation housing 260 and a complementary housing 26 of depth less than the diameter of the ball 6, that the bolt 3 or respectively the second component 2 includes, for the relative drive between the second component 2 and the bolt 3 by the ball 6 when it is simultaneously braced on a channel 262 and a complementary housing 26.

More particularly, the first component 1 and the second component 2 are substantially of revolution about the same axis D, the first component 1 includes a first surface 11 arranged to complementarily cooperate with a second surface 21 that the second component 2 includes, so as to compress therewith this at least one sealing and friction joint 9 interposed between the first surface 11 and the second surface 21. The bolt 3 is preferably also substantially of revolution about the axis D, and is arranged to secure the first component 1 with the second component 2 by screwing and/or elastic retention in an axial blocking position in the direction of the axis D;

To this end, in the non-limiting variant illustrated by the figures, the bolt 3 includes, on the one hand, first fastening means 31 which are arranged to cooperate with first complementary fastening means 13 that the first component 1 includes, and includes on the other hand, second fastening or support means 32 which are arranged to cooperate with second complementary fastening or support means 23 that the second component 2 includes.

In the illustrated variant, the bolt 3 cooperates by screwing with the first component 1, but it could also cooperate with it in the form of an elastic, bayonet connection, or the like.

Thus, the ball 6 is freely movable between the upper surface 28 and the lower surface 38, and is capable of occupying, in a static rest position of the sub-assembly of external parts 100 and under the effect of the only gravity field, a well 261, which well 261 is arranged to entirely house the ball 6 below the level of the upper surface 28 or respectively of the lower surface 38; this well 261 can, alternatively, contain a resilient element, such as a foam or spring, to dampen any noise from the ball when the sub-assembly 100 is handled. And the ball 6 is capable of occupying, during an adjustment operation during which the ball 6 is subjected to the gravity field and/or a magnetic field, both an orientation housing 260 and such a complementary housing 26, for the relative drive between the second component 2 and the bolt 3 by the ball 6 in the manner of a free wheel when the ball 6 is braced both on a channel 262 and a complementary housing 26.

More particularly, the sub-assembly of external parts 100 includes a plurality of complementary housings 26.

More particularly, on each orientation housing 260, the channels 262 are limited by limiting borders 270 arranged to prevent the exit of the ball 6, and each complementary housing 26 is limited by edges 27 arranged to prevent, in the same way, the exit of the ball 6.

In the illustrated variant where the surfaces of cooperation between the first component 1, the second component 2, and the bolt 3 are substantially of revolution about a common axis D, the orientation housing 260 and each complementary housing 26 occupies a sector of revolution about the same axis. In another non-illustrated variant, the component which carries the orientation housing 260, either the bolt 3 or respectively the second component 2, carries several such orientation housings 260.

More particularly, the bolt 3 includes a ring 5, which is arranged to receive, on only part of its periphery, at least one removable insert 4 for tensioning the ring 5.

More particularly, this at least one removable insert 4 is insertable and extractable in the direction of the axis D, and the ring 5 includes, on either side of a slot that it includes, a housing 35, or respectively a post, arranged to complementarily cooperate with a post 42, or respectively a housing, that such a removable insert 4 includes for its radial retention relative to the axis D.

More particularly, the ring 5 is an elastic split ring.

More particularly and without limitation, and as visible in the variant illustrated by the figures, the first fastening means 31 are constituted by a threading, arranged to cooperate with a tapping, which constitutes the first complementary fastening means 13. More particularly, the ring 5 includes the threading 31, and the removable insert 4 has no threading to allow its axial insertion once the ring 5 is mounted.

More particularly, the second fastening or support means 32 are constituted by an upper surface that a lower collar 34 includes, that the bolt 3 includes, and the second complementary fastening or support means 23 are constituted by a lower surface that an upper collar 24 includes that the second component 4 includes. More particularly, the lower collar 34 and/or the upper collar 24 is elastic.

More particularly, at least one sealing and friction joint 9 is housed in a joint groove 29 that the second component 2 or the first component 1 includes.

In an advantageous variant, and as visible in the figures, the first component 1 is a middle part and the second component 2 is a back.

In another variant, the first component 1 is a middle part and the second component 2 is a flange or a bezel.

In yet another variant, the first component 1 is a middle part or a tube attached to a middle part, and the second component 2 is a crown or a crown rod or a push-piece.

In a particular embodiment, the bolt 3 includes at least one elastic element, which is arranged to constitute means of radial repulsion tending to press the first component 1 and the second component 2 on each other.

The invention also relates to a timepiece, in particular a watch 1000 including such a sub-assembly of external parts 100.

The invention also relates to a piece of jewellery including such a sub-assembly of external parts 100.

The invention also relates to a method for assembling such a sub-assembly of external parts 100. According to the invention, the ball 6 is inserted into an orientation housing 260, the second component 2 is assembled with the bolt 3, the at least one sealing and friction joint 9 is positioned between the second component 2 and the first component 1, and the ball 6 is brought into cooperation with a complementary housing 26 by subjecting it to a magnetic field and/or reversing its position relative to the gravity field, for example by turning the assembly over, and the ball 6 is braced on a channel 262 by relative rotation between the bolt 3 and the second component 2, so as to be able to screw the bolt 3 and the first component 1 together, the complete screwing at the recommended torque is carried out between the bolt 3 and the first component 1, then the ball 6 is released, then the second component 2 is angularly oriented relative to the first component 1 by driving it in the direction opposite to the direction of screwing to the desired position.

More particularly, in order to proceed with the dismounting of the sub-assembly of external parts 100, the ball 6 is subjected to a magnetic field and/or its position is reversed relative to the gravity field, the second component 2 is continued to be driven in the direction opposite to the screwing direction until the ball 6 is in a position of cooperation between a complementary housing 26 and the channel 262 opposite to that which was used for the screwing, for driving the bolt 3 in order to unscrew it from the first component 1.

The invention is suited for numerous watchmaking applications, for example for a helium valve on a diving watch, or else for external part components such as a bracelet, a buckle, a clasp, or the like. The same applies in jewellery, to close cuff links, earrings, or else to fix precious stones or decorated elements which are removably designed.

The invention also relates to a timepiece or watch 1000 including such a sub-assembly of external parts 100.

The invention also relates to a piece of jewellery including such a sub-assembly 100.

The invention allows ensuring the perfect orientation of a component kept blocked in its service position.

The invention also allows cooperating antagonistic components made of materials of different natures, without stress of expansion friction, elasticity, or the like, without requiring an external fastening element such as screws or the like, without a screw thread nor machining liable to weaken particular materials such as ceramics, sapphire, and the like. It has a very good resistance to accidental or even voluntary unscrewing by vibration or of the Chapuis-choc type. The invention also allows ensuring the interchangeability of the components, and, consequently, an increased personalisation of the watches or the pieces of jewellery of the users.

This invention is applicable both to watches or pieces of jewellery made of precious materials and to mass-produced products including components of low unit cost, in particular made of plastic material or the like.

The invention is well suited in the cases where the sub-assembly 100 includes components made of different materials, with different expansion coefficients, or else fragile or hard materials (ceramic, sapphire, precious stones, gems, cameos), which do not allow standard fastening modes. Among conventional configurations mention can be made of assembling a gold middle part with a sapphire back, or an entirely ceramic case, a metal-ceramic combination, or the like. The components can thus be made of all kinds of materials: metal alloys, in particular precious or titrated metal alloys, stainless steels, at least partially amorphous metal alloys, or "Liquidmetal©" or the like, ceramics, sapphire, minerals, hard stones, rubber, plastic materials and in particular thermoplastic elastomers called TPE including in particular thermoplastic polyurethane called TPU, polycarbonates called PC, polyvinyl chlorides called PVC, polyacetals or polyoxymethylene called POM, silicone, "Nylon®", to name, in a non-limiting manner, only materials which are common in watchmaking and jewellery.

The invention claimed is:

1. A sub-assembly of external parts for a timepiece or for a watch or for a piece of jewellery, comprising, coaxially with a first component and a second component compressing together at least one sealing and friction joint, and interposed therebetween, a bolt securing them together by axially blocking said first component, and a lower surface of which, in the assembled position, directly faces an upper surface of said second component, wherein said lower surface is arranged to cooperate with said upper surface to enclose a ball arranged to occupy, in a static rest position, a well of depth greater than a diameter of said ball that an orientation housing in said second component or said bolt includes, the well being framed by channels of depth less than the diameter of said ball and limited by limitation borders, and wherein the ball is configured to occupy, during an adjustment where the ball is subjected to a gravity field and/or a magnetic field, both an orientation housing in said second component and a complementary housing in said bolt, the complementary housing having a depth less than the diameter of said ball, for a relative drive between said second component and said bolt by said ball when said ball is simultaneously braced on said channel and said complementary housing.

2. The sub-assembly of external parts according to claim 1, wherein said first component includes a first surface arranged to complementarily cooperate with a second surface that said second component includes so as to compress together said at least one sealing and friction joint interposed between said first surface and said second surface, said bolt being arranged to secure said first component with said second component by screwing and/or elastic retention in an axial blocking position in the direction of said axis, said bolt including first fastening means arranged to cooperate with first complementary fastening means that said first component includes, and second fastening or support means arranged to cooperate with second complementary fastening or support means that said second component includes.

3. The sub-assembly of external parts according to claim 1, wherein said ball is freely movable between said upper surface and said lower surface, and is capable of occupying, in a static rest position of said sub-assembly of external parts and under an effect of the gravity field, said well, said well being arranged to entirely house said ball below a level of said upper surface or respectively of said lower surface, and wherein said ball is capable of occupying, during an adjustment operation during which said ball is subjected to the gravity field and/or the magnetic field, both said orientation housing and a complementary housing that said bolt or respectively said second component includes and which is of depth less than the diameter of said ball, for the relative drive between said second component and said bolt by said ball in a manner of a free wheel when said ball is braced both on said channel and said complementary housing.

4. The sub-assembly of external parts according to claim 1, wherein said sub-assembly of external parts includes a plurality of said complementary housings.

5. The sub-assembly of external parts according to claim 1, wherein, on each said orientation housing, said channels are limited by said limiting borders arranged to prevent the exit of said ball, and wherein each complementary housing is limited by edges arranged to prevent the exit of said ball.

6. The sub-assembly of external parts according to claim 2, wherein said bolt includes a ring arranged to receive, on only part of its periphery, at least one removable insert for tensioning said ring.

7. The sub-assembly of external parts according to claim 6, wherein said at least one removable insert is insertable and extractable in the direction of said axis, in that said ring includes, on either side of a slot that it includes, a housing, or respectively a post, arranged to complementarily cooperate with a post, or respectively a housing, that said removable insert includes for its radial retention relative to said axis.

8. The sub-assembly of external parts according to claim 6, wherein said ring is an elastic split ring.

9. The sub-assembly of external parts according to claim 6, wherein said first fastening means are constituted by a threading arranged to cooperate with a tapping constituting said first complementary fastening means.

10. The sub-assembly of external parts according to claim 9, wherein said ring includes said threading, and wherein said removable insert has no threading.

11. The sub-assembly of external parts according to claim 1, wherein said second fastening or support means are constituted by an upper surface that a lower collar includes that said bolt includes, and wherein said second complementary fastening or support means are constituted by a lower surface that an upper collar includes that said second component includes.

12. The sub-assembly of external parts according to claim 11, wherein said lower collar and/or said upper collar is elastic.

13. The sub-assembly of external parts according to claim 1, wherein at least one said sealing and friction joint is housed in a joint groove that said second component or said first component includes.

14. The sub-assembly of external parts according to claim 1, wherein said first component is a middle part and said second component is a back.

15. The sub-assembly of external parts according to claim 1, wherein said first component is a middle part and said second component is a flange or a bezel.

16. The sub-assembly of external parts according to claim 1, wherein said first component is a middle part or a tube attached to a middle part, and said second component is a crown or a crown rod or a push-piece.

17. The subassembly of externals parts according to claim 1, wherein said bolt includes at least one elastic element arranged to constitute means of radial repulsion tending to press said first component and said second component on each other.

18. The watch comprising the sub-assembly of external parts according to claim 1.

19. The piece of jewellery comprising the sub-assembly of external parts according to claim 1.

20. A method for assembling the sub-assembly of external parts according to claim 9, the method comprising:

inserting said ball into said orientation housing, assembling said second component with said bolt, positioning said at least one sealing and friction joint between said second component and said first component, and bringing said ball into cooperation with said complementary housing by subjecting said ball to the magnetic field and/or by reversing a position of the ball relative to the gravity field, said ball being braced on said channel by relative rotation between said bolt and said second component, so as to be able to screw said bolt and said first component together, screwing said bolt and said first component at a predetermined torque, after the screwing, releasing said ball, and after the releasing, driving said second component in a direction opposite to a direction of the screwing until the second component is angularly oriented relative to said first component to a desired position.

21. The assembly method according to claim 20, further comprising dismounting said sub-assembly of external parts, the dismounting including:

subjecting said ball to the magnetic field and/or reversing the position of the ball relative to the gravity field, driving the second component in the direction opposite to the direction of the screwing until said ball reaches a position of cooperation between said complementary housing and the channel, and driving, once the ball reaches the position of cooperation, said bolt to unscrew the bolt from said first component.

* * * * *